US009339103B1

(12) United States Patent
Watters

(10) Patent No.: US 9,339,103 B1
(45) Date of Patent: May 17, 2016

(54) TOOTHBRUSH WITH TOOTHPASTE DISPENSING APPLICATOR

(71) Applicant: Susan Watters, Selma, AL (US)

(72) Inventor: Susan Watters, Selma, AL (US)

( * ) Notice: Subject to any disclaimer, the term of this patent is extended or adjusted under 35 U.S.C. 154(b) by 0 days.

(21) Appl. No.: 14/563,349

(22) Filed: Dec. 8, 2014

Related U.S. Application Data

(60) Provisional application No. 61/912,851, filed on Dec. 6, 2013.

(51) Int. Cl.
*A46B 11/00* (2006.01)
*B65D 35/28* (2006.01)

(52) U.S. Cl.
CPC ..... *A46B 11/0065* (2013.01); *A46B 11/0072* (2013.01); *B65D 35/28* (2013.01)

(58) Field of Classification Search
CPC combination set(s) only.
See application file for complete search history.

(56) References Cited

U.S. PATENT DOCUMENTS 1,465,840 A * 8/1923 Celano ..... A46B 11/0024 132/311
1,772,409 A * 8/1930 Wood ..... A46B 11/0024 222/101
1,776,808 A * 9/1930 Hawksley ..... A46B 11/0006 401/152
1,959,126 A * 5/1934 De Luca ..... A46B 11/0024 401/155
3,549,268 A * 12/1970 Casselman ..... A46B 11/0024 401/154
3,995,648 A 12/1976 Kuryla
4,062,635 A 12/1977 Teh-Sheng
4,421,433 A 12/1983 Villanueva
5,382,106 A * 1/1995 Voigt ..... A46B 11/0017 222/100
5,908,257 A 6/1999 Martin
5,913,632 A 6/1999 Persad
6,238,118 B1 5/2001 Tryon
7,244,073 B2 7/2007 Trocino
8,496,393 B2 7/2013 Martin et al.

* cited by examiner

*Primary Examiner* — David Walczak
(74) *Attorney, Agent, or Firm* — Robert C. Montgomery; Montgomery Patent & Design

(57) ABSTRACT

A toothbrush device has a hollow handle, an open end, and a bristled brush. A tube of toothpaste is inserted into the handle and an internal roll bar assembly is actuated via a knob disposed on an exterior surface of the handle. The roll bar assembly traverses an interior space of the handle to collapse the toothpaste tube, squeezing the tube and conveying toothpaste through an interior conduit portion of the toothbrush. The toothpaste is subsequently dispensed from below the bristled brush portion, whereupon a user may brush their teeth in a normal manner using the device.

14 Claims, 4 Drawing Sheets

TOOTHBRUSH WITH TOOTHPASTE DISPENSING APPLICATOR

RELATED APPLICATIONS

The present invention is a continuation-in-part of, was first described in, and claims the benefit of U.S. Provisional Application No. 61/912,851, filed Dec. 6, 2013, the entire disclosures of which are incorporated herein by reference.

FIELD OF THE INVENTION

The present invention relates to a toothbrush equipped with a toothpaste dispensing applicator that, upon receipt of a toothpaste tube, controllably dispenses toothpaste onto bristles of the toothbrush.

BACKGROUND OF THE INVENTION

Conventional toothbrushes require a user to actively spread toothpaste on the brush head of the toothbrush from a separate toothpaste tube. Toothpaste tubes are generally malleable plastic tubes, which enables a user to extract toothpaste from within by squeezing the tube to force the toothpaste from a nozzle end of the tube. While not a complicated procedure, it does require some dexterity to accurately dispense toothpaste from a toothpaste tube and dispose it onto a toothbrush head. Additional dexterity is required to dispose a measured amount from the toothpaste tube so as to not result in waste This might not seem terribly problematic for most, but for those with disabilities and debilitating ailments this can pose as a difficult task. Moreover, convention has forced all of us, disabled or not, to deal with toothpaste containers that are separate from the toothbrush. This becomes a burden by constantly having to store and transport two (2) separate items. It would advantageous to provide a means to extract toothpaste from a conventional toothpaste tube and dispose it on a brush head of a toothbrush in a controlled manner. An additional benefit would be to provide a means to operate the toothbrush with ease, especially for those with compromised fine motor skills. A further benefit would be to combine the toothbrush and the toothpaste tube in a way that would enable exploitation of conventional toothpaste containers so as to not require costly reconfigurations of how toothpaste is packaged and sold. The development of the present invention fulfills this need.

SUMMARY OF THE INVENTION

It is therefore an object of the present invention to provide such a toothbrush that enables one to attach a toothpaste tube and advance toothpaste from the tube onto bristles.

An object of the present invention is to provide such a toothbrush having an elongated tubular member with a hollow construction. The tubular member has an open applicator end, capable of having an applicator removably attached thereto, and an open rear end opposite the applicator end. A toothpaste tube is capable of being placed within the tubular member. A roller travels along at least one (1) track mechanism within the tubular member, having a knob that extends out from the tubular member through an elongated slot along one (1) side thereof and configured longitudinally between the applicator end and rear end. Fluid communication is maintained between an interior of the tubular member and the applicator, when attached thereto. The roller is capable of being operated by a user to transfer an amount of toothpaste from the toothpaste tube into the applicator for subsequent use.

Another object of the present invention is to provide such track mechanisms to have a rack gear enabling the roller to travel longitudinally along each track assembly. In certain embodiments, the rack gear is integrally molded with the tubular member.

Another object of the present invention is to provide such a roller to include, a shaft extending from the roller outward through the elongated slot, a knob removably attached to the shaft opposite the roller and residing external from the tubular member, and at least one (1) pinion gear disposed on the shaft. Each pinion gear is configured to engage an individual rack gear such that the said roller is configured to press the toothpaste tube against an inner surface of the tubular member. In at least one (1) embodiment the roller is adapted to be at least as wide as the toothpaste tube to ensure total dispensing of toothpaste from the toothpaste tube. In another embodiment, there are a pair of rack gears within the toothpaste tube and a pair of pinion gear on the roller.

Yet another object of the present invention is to provide such an applicator having a coupler portion with a first end capable of removably attaching to the tubular member applicator end and a head portion extending outward from a second end of the coupler portion. A plurality of ducts are within the coupler portion each in fluid communication with and extending from the tubular member applicator end and terminating at an exit port located on a front face of the head portion. A plurality of bristles is disposed on the front face and configured such that each exit port is huddled by the plurality of bristles. When the roller forces contents from the toothpaste tube, when the applicator is attached, the contents travel through each duct to exit through each exit port. In at least one (1) embodiment, a neck portion exists at a transition point between the coupler portion and the head portion.

In still another object of the present invention, the coupler portion in one (1) embodiment has a threaded annular ring along an inner surface to threadingly secure a tip of the toothpaste tube. In another embodiment, the coupler portion further comprises an annular ring along an inner surface to frictionally engage and secure the tip of said ancillary toothpaste tube.

In still another object of the present invention, an end cap is configured to cover and secure to the open rear end.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
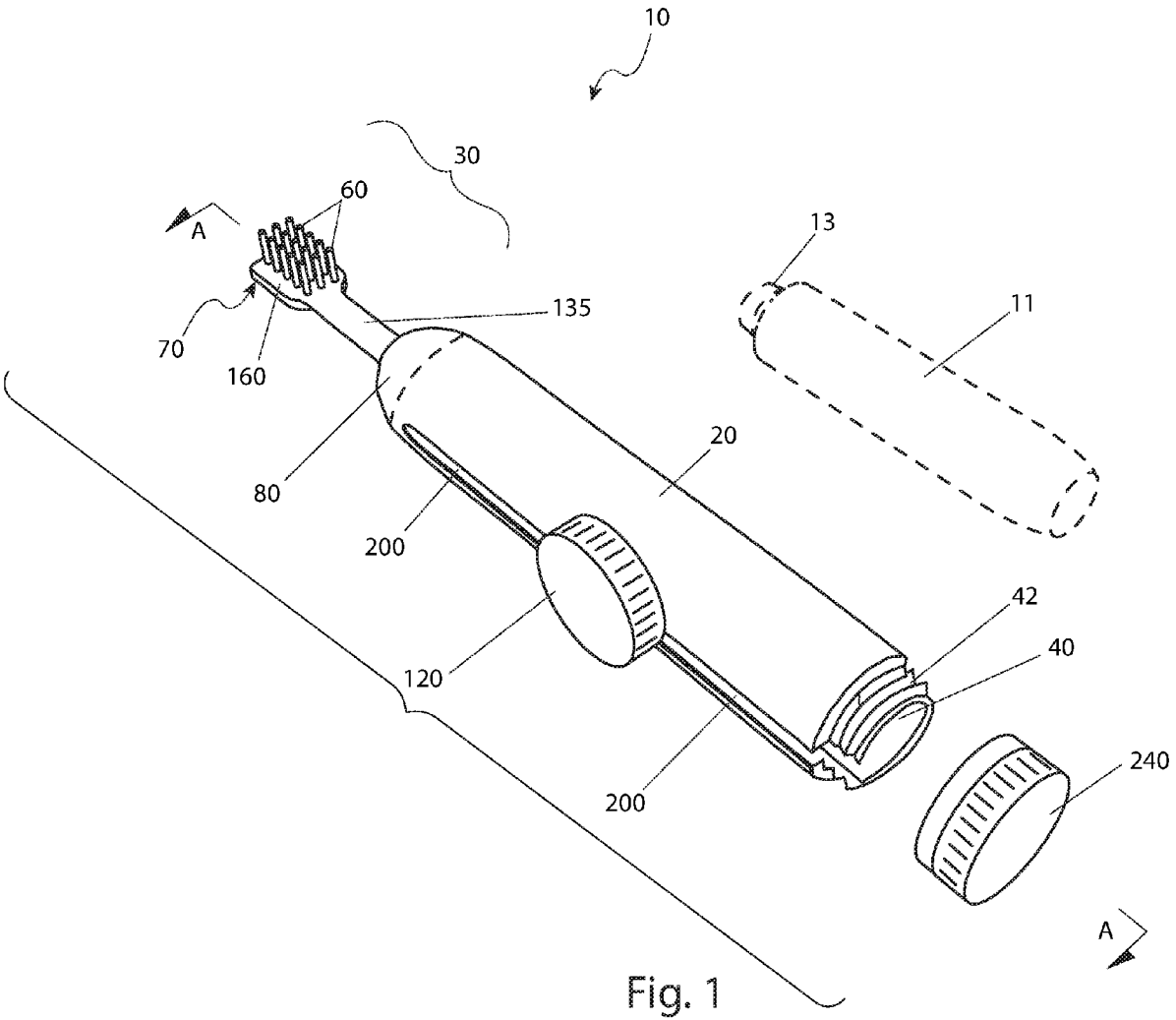
FIG. 1 is a perspective view of toothbrush with a toothpaste dispensing applicator 10 and a toothpaste tube 11, in accordance with the preferred embodiment of the present invention.

10 toothbrush with a toothpaste dispensing applicator
11 toothpaste tube
12 toothpaste
13 tube cap
14 nozzle
15 purged tube portion
20 housing assembly
22 housing
40 open end
42 male threaded surface
44 female threaded surface
50 interior space
60 bristle
70 applicator section
80 coupling
82 joint feature
110 roller
113 shaft
115*a* first pinion gear
115*b* second pinion gear
120 knob
130 conduit
135 neck
140 duct
150 exit port
155*a* first nozzle receiver
155*b* second nozzle receiver
160 front face
170*a* first rack gear
170*b* second rack gear
200 slot
210 fastening mechanism
220 inner surface
240 end cap

DETAILED DESCRIPTION OF THE PREFERRED EMBODIMENT

Figure 2:
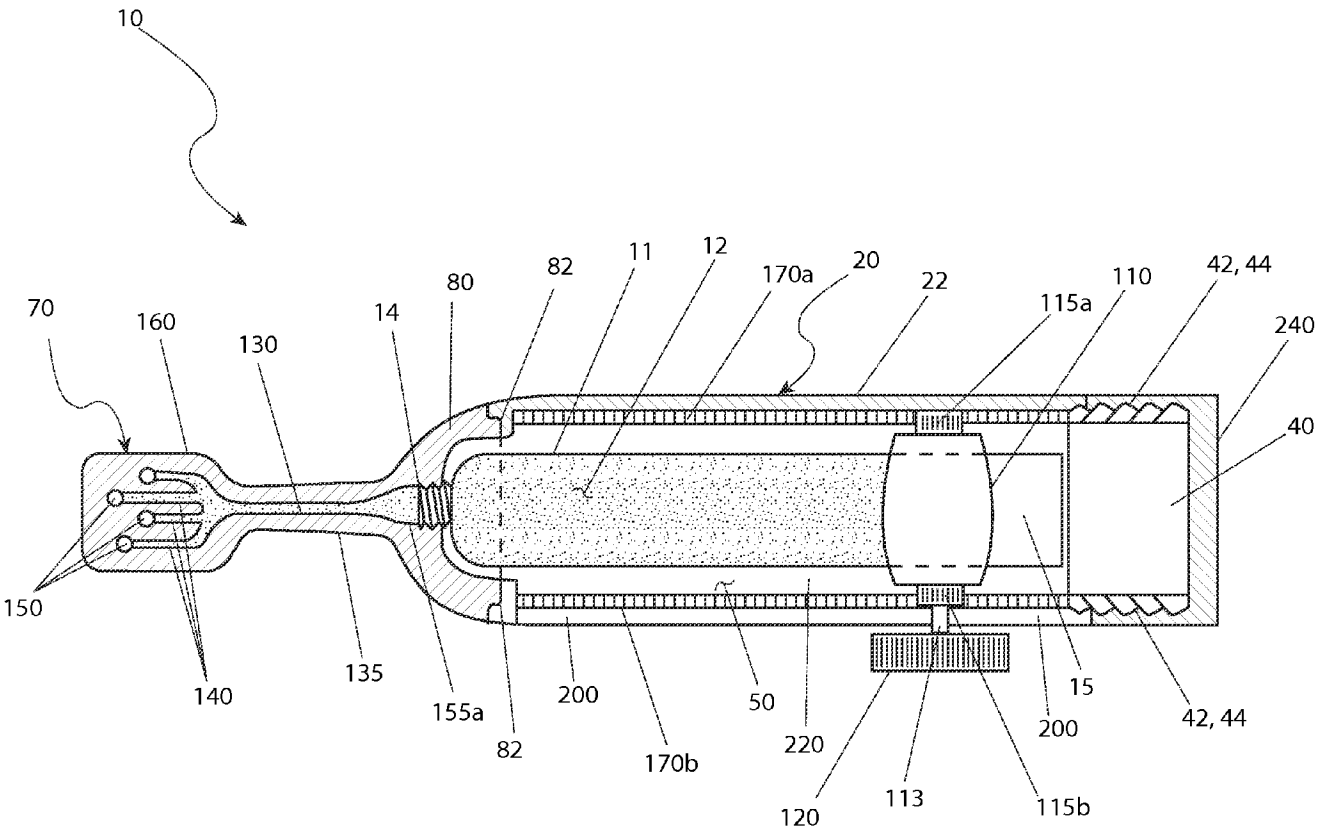
FIG. 2 is a horizontal sectional view along section line A-A (see FIG. 1) of the dispensing applicator 10, in accordance with the preferred embodiment of the present invention.
Figure 3:
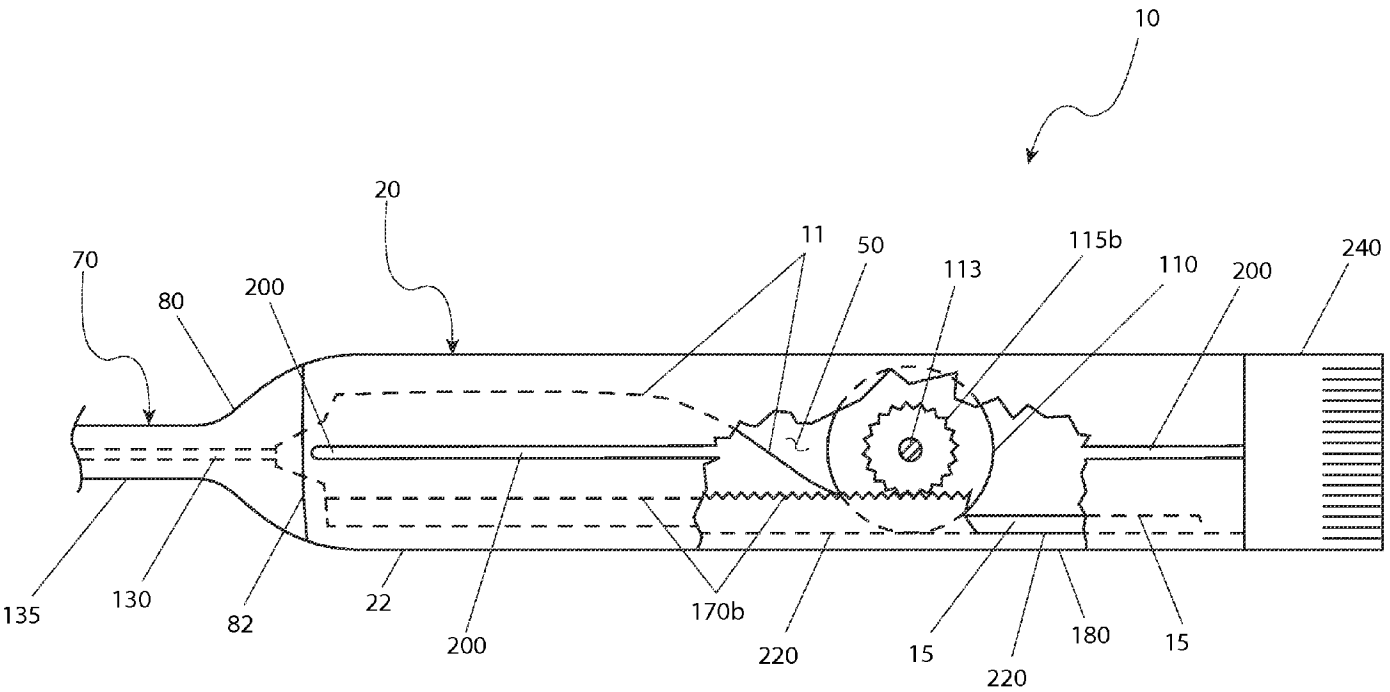
FIG. 3 is a side view of the toothpaste dispensing applicator 10 showing a cut away portion of a housing assembly 20 to reveal a roller 110 and rack gear 170*a* portions, in accordance with the preferred embodiment of the present invention.
Figure 4A:
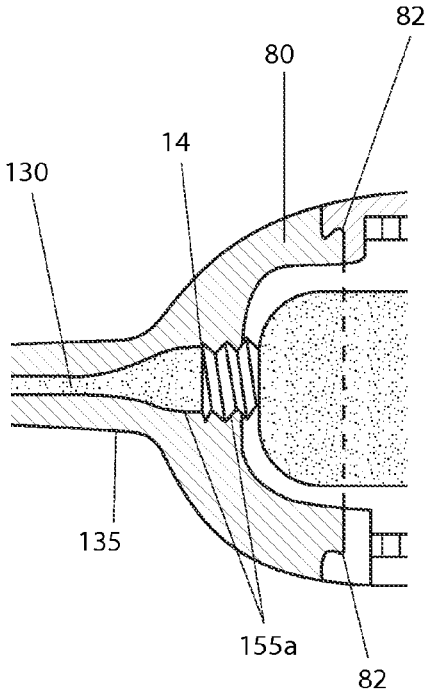
FIG. 4*a* is a sectional view of a first nozzle receiver portion 155*a* of the dispensing applicator 10 taken along section line A-A (see FIG. 1), in accordance with the preferred embodiment of the present invention; and, FIG. 4*b* is a sectional view of a second nozzle receiver portion 155*b* of the dispensing applicator 10 also taken along section line A-A (see FIG. 1), in accordance with an alternate embodiment of the present invention.
Figure 4B:
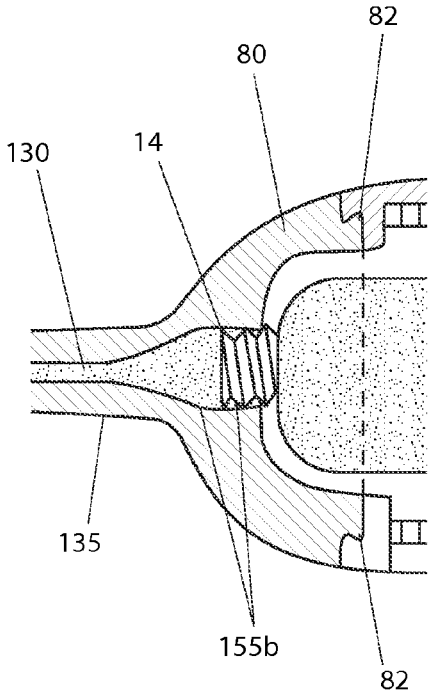

The best mode for carrying out the invention is presented in terms of its preferred embodiment, herein depicted within FIGS. 1 through 4*a*, and in terms of an alternate embodiment, herein depicted within FIG. 4*b*. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one (1) of the referenced items.

The present invention describes a toothbrush with a toothpaste dispensing applicator (herein described as the "device") 10 which receives and contains a purchased toothpaste tube 11 and controllably dispenses toothpaste 12 internally into an applicator section 70 of the device 10 via manipulation of an internal roller 110.

Referring now to FIGS. 1 and 2, a perspective view of the device 10 and a toothpaste tube 11, and a horizontal sectional view of the device 10 taken along section line A-A, in accordance with the preferred embodiment of the present invention, are disclosed. The device 10 comprises a cylinder-shaped housing assembly 20 including a tubular housing 22 having an open end 40 with an end cap 240, and a toothpaste applicator section 70. The housing assembly 20 provides an internal track mechanism molded into the housing 22, whereby a roller 110 is used in conjunction with gear portions 115*a*, 115*b*, 170*a*, 170*b* to traverse an interior space 50 of the housing 22 and collapse a toothpaste tube 11 removably placed within the interior space 50 (also see FIG. 3).

The housing assembly 20 includes an elongated slot 200 located along a longitudinal side thereof. The interior space 50 provides enclosure of an oval-shaped or spherical roller 110 which is centered above, and at least as wide as the toothpaste tube 11. The roller 110 is manipulated by a user so as to collapse the toothpaste tube 11, thereby resulting in a flow of toothpaste 12 into the applicator section 70. The roller 110 is operably motioned via integral axial portions including first pinion gear 115*a* and second pinion gear 115*b* portions located along opposing side portions thereof. The pinion gears 115*a*, 115*b* are driven in a forward direction via engagement with respective stationary linear first rack gear 170*a* and second rack gear 170*b* portions causing a relative motioning of the roller 110. The rack gears 170*a*, 170*b* are integrally-molded into opposing side portions of the housing 22, being arranged in a longitudinal and parallel manner. The roller 110 also includes an integral shaft portion 113 which protrudes outwardly from the second pinion gear 115*b* and through the aforementioned slot 200. The shaft 113 has an integral knob portion 120 at an end portion residing along an external surface of the housing 22. As a user turns the knob 120, a torsional force is communicated to the roller 110 and pinion gear portions 115*a*, 115*b* enabling the roller 110 to traverse forwardly along the rack gears 170*a*, 170*b* within the interior space 50. A forward motion presses upon and collapses the toothpaste tube 11, and a rearward motion removes the roller 110 from contact with the toothpaste tube 11.

The applicator section 70 is removably attached to the housing assembly 20 via a coupling 80. The coupling 80 facilitates a mechanical connection between the housing assembly 20 and the applicator section 70, as well as providing an attachment means to the toothpaste tube 11. The coupling 80 includes an annular joint feature 82 along an exterior edge portion which provides a "snapping" connection to the housing assembly 20 via an interfering fit of respective insertable perimeter edge features. The applicator section 70 is in fluid communication with an internal conduit portion 130 to convey the toothpaste 12 from the toothpaste tube 11 to bristles 60 disposed upon a front face 160 portion of the applicator section 70. The applicator section 70 includes an elongated neck portion 135 positioned between the coupling 80 and front face 160 portions, containing the central conduit 130. The distal end portion of the conduit 130 transforms into a plurality of divergent duct portions 140 which provide a means to distribute and disperse the toothpaste 12 across the bristles 60. Each duct 140 includes an exit port 150 positioned below the aforementioned bristles 60 enabling dispensing of the toothpaste 12 from a plurality of locations. When the toothpaste 12 is dispensed through the exit ports 150, it becomes entwined with the bristles 60.

The opposing proximal end of the conduit 130 terminates in a preferred first nozzle receiver 155*a* being shaped to threadingly receive a nozzle portion 14 of a purchased toothpaste tube 11 therein (see FIGS. 4*a* and 4*b*).

In use, the end cap 240 is removed and a toothpaste tube 11 is inserted into the open end 40 of the housing 22 where a nozzle portion 14 of the toothpaste tube 11 connectively engages the first nozzle receiver 155*a*. The roller 110 is then inserted into the housing 22 and the cap 240 is replaced. The roller 110 is then actuated by turning the knob 120 which in turn progressively collapses the toothpaste tube 11, squeezing the toothpaste 12 through the applicator section 70 and onto the bristles 60.

The housing assembly 20 is envisioned to be made using a light-weight rigid plastic material, and has a profile similar to a conventional toothpaste tube 11. The open end 40 is envisioned to be sized so as to enable receipt of a commercially-available toothpaste tube 11. The housing 22 is provided with an inner surface 220 against which the toothpaste tube 11 is supported. As the toothpaste tube 11 is collapsed, a purged tube portion 15 remains upon the inner surface 220 in a stable manner as the roller 110 traverses the interior space 50 of the housing 22.

Referring now to FIG. 3, a side view of the device 10 showing a cut away portion of a housing assembly 20 to reveal the roller 110 and rack gear 170*a*, 170*b* portions, in accordance with the preferred embodiment of the present invention, is disclosed. Note that FIG. 3 is shown with the knob 120 removed from the shaft 113 for illustration sake.

The rack gear portions 170*a*, 170*b* are integral to opposing interior surfaces of the housing 22, and are positioned along a longitudinal length thereof. The rack gear portions 170*a*, 170*b* begin near the coupling 80 and merge into the open end 40, and include a toothed top surface. The rack gear portions 170*a*, 170*b* are situated adjacent to and below the slot 200 when the device 10 is laid upon its side. The relative positions of the rack gear portions 170*a*, 170*b*, the slot 200, and the interior space 50 are such that as a toothpaste tube 11 is inserted into the housing 22, the toothpaste tube 11 rests between the rack gear portions 170*a*, 170*b*, upon the inner surface 220, and adjacent to the slot 200. As the roller 110 traverses the interior space 50, the roller 110 presses the toothpaste tube 11 against a bottom portion of the inner surface 220.

After the toothpaste tube 11 is inserted into the open end 40, the roller 110 is subsequently inserted into the open end 40 where the integral pinion gear portions 115*a*, 115*b* engage, and are guided by, the rack gear portions 170*a*, 170*b*. As the roller 110 is guided by the rack gear portions 170*a*, 170*b*, the shaft 113 and knob 240 portions protrude from the slot 200, enabling a user to operate the device 10 by rotating the knob 120 to transfer rotational forces to the roller 110. The knob 120 is envisioned to be a circular dial-style knob. The knob 120 is envisioned to be a circular dial-style knob with a fastening mechanism disposed on a rear surface thereof. The shaft 113 is preferably configured to have a keyed section such as a polyhedron cross section, where the fastening mechanism is preferably a formation within the knob 120 that has a complementary configuration so that both removably secure to each other via an interference fit.

As the knob 120 is rotated, the roller 110 acts upon the toothpaste tube 11 and entrains toothpaste 12 within the forward portion of the toothpaste tube 11. The slot 200 enables the roller 110 and the knob 120 to traverse a longitudinal length of the housing assembly 20. As the roller 110 traverses the housing 22 towards the applicator section 70, the roller 110 forces the toothpaste 12 from the toothpaste tube 11, through the coupling 80, into the applicator section 70, through the conduit 130, and out each exit port 150 where it entwines with the bristles 60. The housing assembly 20 is to be shaped so as to allow comfortable grasping in a user's hand, and utilized to brush one's teeth in a similar manner as a normal toothbrush.

The open end 40 includes an integral male threaded surface 42 which engages a correspondingly sized female threaded surface 44 of the end cap 240 for removable securement thereof; however, other methods of removable securement of the end cap 240 may be utilized without deviating from the teachings of the device 10.

Referring now to FIGS. 4*a* and 4*b*, a sectional view of the first nozzle receiver 155*a* and alternate second nozzle receiver 155*b* portions of the device 10, are disclosed. The nozzle receivers 155*a*, 155*b* provide alternate means to secure a purchased toothpaste tube 11 to the device 10. The nozzle receiver 155*a*, 155*b* is located within the coupling 80. The first nozzle receiver 155*a* is shaped to threadingly receive a nozzle portion 14 of a purchased toothpaste tube 11 therein. The second nozzle receiver 155*b* provides a cylindrical shape, thereby utilizing a light press-fit connection; however, other styles and methods of removably securing the toothpaste tube 11 to the nozzle receiver 155*a*, 155*b* may be utilized without deviating from the teachings of the device 10.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the device 10, it would be installed as indicated in FIGS. 1 and 2.

The method of preparing and utilizing the device 10 may be achieved by performing the following steps: acquiring a model of the device 10; removing the end cap 240 from the housing assembly 20; removing the tube cap 13 from a purchased toothpaste tube 11; inserting the toothpaste tube 11 into the open end 40 of the housing 22 to reside within the interior space 50; securing the toothpaste tube 11 into the first nozzle receiver portion 155*a* of the coupling 80; inserting the roller 110 into the open end 40 with the shaft 113 and knob 120 portions protruding outwardly from the slot 200; allowing the slot 200 to guide the roller 110 so that it pins the toothpaste tube 11 against the inner surface 220 of the housing 22; initiating a flow of toothpaste 12 by advancing the roller 110 toward the applicator section 70 by rotating the knob 120; forcing toothpaste 12 from the toothpaste tube 11 and into the applicator section 70; allowing the toothpaste 12 to flow through the conduit 130 and exit ports 150 of the applicator section 70 until a desired volume of toothpaste 12 is disposed onto the bristles 60; allowing the engagement of the rack gears 170*a*, 170*b* and pinion gears 115*a*, 115*b* to maintain the roller 110 in a stationary position; holding the housing assembly 20 in one's hand and employing the device 10 to clean one's teeth; advancing the roller 110 towards the applicator section 70 to dispense additional toothpaste 12 as needed; repeating the previous steps until the knob 120 abuts an end portion of the slot 200; replenishing the supply of toothpaste 12 by removing the end cap 240; reversing rotation of the roller 110 until it reaches the open end 40; removing the roller 110 from the housing 22; rotating the spent toothpaste tube 11 from the first nozzle receiver 155*a*; installing a new toothpaste tube 11 as previously described; repeating the steps above to employ the device 10 as needed to clean a user's teeth; and, benefiting from an easily dispensed supply of toothpaste 12 afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A toothbrush with dispensing applicator, comprising:

an elongated tubular member, having a hollow construction capable of receiving and retaining a tube of toothpaste, comprising:

an open applicator end;

an open rear end opposite said applicator end; and, an elongated slot along one side of said tubular member and configured longitudinally from said applicator end to said rear end;

at least one track mechanism affixed to an interior surface of said tubular member, comprising a rack gear;

a roller operatively motionable to travel longitudinally along said track mechanism, said roller comprises:

a shaft having a diameter less than a diameter of said roller and extending from said roller outward through said elongated slot;

a knob removably attached to said shaft opposite said roller, said knob residing external from said tubular member; and at least one pinion gear disposed on said shaft and in direct contact with said roller, said pinion gear residing internal of said tubular member;

wherein said pinion gear is configured to engage said rack gear; and wherein said roller is configured to press said tube of toothpaste against an inner surface of said tubular member; and an applicator removably attached to said applicator end, further comprising a conduit positioned therewithin;

wherein fluid communication is maintained between an interior of said tubular member, said conduit, and said applicator, when attached to said tubular member; and, wherein advancement of said roller towards said applicator end is capable of being operated by a user to transfer contents within said tube of toothpaste into said conduit and to exit applicator.

2. The toothbrush recited in claim 1, wherein said roller is adapted to be at least as wide as said tube of toothpaste.

3. The toothbrush recited in claim 1, further comprising:

a pair of rack gears, each disposed parallel to each other; and, a pair of pinion gears disposed on said shank adjacent distal ends of said roller.

4. The toothbrush recited in claim 3, wherein each rack gear is integrally molded with said tubular member.

5. The toothbrush recited in claim 1, wherein said knob comprises:

a circular disk; and, a fastening means located on a surface of said circular disk to removably secure said knob to said shaft;

wherein said knob is acted upon to transfer rotational motion to said roller.

6. The toothbrush recited in claim 5, wherein said shaft has a polyhedron cross sectional shape and said fastening means has a complementary polyhedron shape to receive said shaft and retain said knob via an interference fit.

7. The toothbrush recited in claim 1, wherein said applicator further comprises:

a coupler portion having a first end capable to removably attach to said tubular member applicator end;

a head portion extending outward from a second end of said coupler portion;

a plurality of ducts each in fluid communication with and extending from said conduit, each duct terminates at an exit port located on a front face of said head portion; and, a plurality of bristles disposed on said front face and configured such that each exit port is huddled by said plurality of bristles;

wherein said contents forced into said conduit travel through each duct to exit through each exit port.

8. The toothbrush recited in claim 7, further comprising a neck portion at a transition point between said coupler portion and said head portion.

9. The toothbrush recited in claim 7, wherein said coupler portion further comprises a threaded annular portion along an inner surface to threadingly secure a tip of said tube of toothpaste.

10. The toothbrush recited in claim 7, wherein said coupler portion further comprises an annular portion along an inner surface to frictionally engage and secure a tip of said tube of toothpaste.

11. The toothbrush recited in claim 1, further comprising an end cap configured to cover said rear end.

12. The toothbrush recited in claim 11, wherein said end cap is removably secured to said rear end.

13. The toothbrush recited in claim 1, wherein said tubular member is a light-weight rigid material.

14. The toothbrush recited in claim 1, wherein each rack gear is integrally molded with said tubular member.

* * * * *